US009846389B2

(12) United States Patent
Tamaki

(10) Patent No.: US 9,846,389 B2
(45) Date of Patent: Dec. 19, 2017

(54) DEVELOPER SUPPLY CONTROL IN ELECTROPHOTOGRAPHIC TYPE IMAGE FORMING APPARATUS

(71) Applicant: KYOCERA Document Solutions Inc., Osaka-shi, Osaka (JP)

(72) Inventor: Kenichi Tamaki, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/299,199

(22) Filed: Oct. 20, 2016

(65) Prior Publication Data

US 2017/0115607 A1 Apr. 27, 2017

(30) Foreign Application Priority Data

Oct. 22, 2015 (JP) ..... 2015-208041

(51) Int. Cl.
*G03G 15/08* (2006.01)

(52) U.S. Cl.
CPC ..... *G03G 15/0891* (2013.01)

(58) Field of Classification Search
CPC ..... G03G 15/0836; G03G 15/0846; G03G 15/0863; G03G 15/0887; G03G 15/0889; G03G 15/0891; G03G 15/0893; G03G 15/0896; G03G 15/5041; G03G 15/553; G03G 15/556
See application file for complete search history.

(56) References Cited

U.S. PATENT DOCUMENTS

2013/0084107 A1* 4/2013 Tamaki ..... G03G 15/0891 399/258
2013/0243450 A1* 9/2013 Suenami ..... G03G 15/0824 399/27

FOREIGN PATENT DOCUMENTS

JP 2005346116 A 12/2005

* cited by examiner

*Primary Examiner* — Joseph S Wong
(74) *Attorney, Agent, or Firm* — Alleman Hall Creasman & Tuttle LLP

(57) ABSTRACT

An image forming apparatus includes a developing portion, a first rotation control portion, and a second rotation control portion. The developing portion has a conveying member configured to convey a developer within a circulation-conveyance passage, and a reducing portion provided in the conveying member and configured to reduce an ability to convey the developer. The first rotation control portion is configured to rotate the conveying member at a predetermined first speed when a printing process is executed. The second rotation control portion is configured to suspend execution of the printing process and rotate the conveying member at a second speed lower than the first speed, when an average coverage rate per page of a printed matter having a predetermined reference number of consecutively printed pages exceeds a predetermined threshold.

6 Claims, 5 Drawing Sheets

DEVELOPER SUPPLY CONTROL IN ELECTROPHOTOGRAPHIC TYPE IMAGE FORMING APPARATUS

INCORPORATION BY REFERENCE

This application is based upon and claims the benefit of priority from the corresponding Japanese Patent Application No. 2015-208041 filed on Oct. 22, 2015, the entire contents of which are incorporated herein by reference.

BACKGROUND

The present disclosure relates to an electrophotographic type image forming apparatus and an image forming method.

An image forming apparatus, such as a printer, which is capable of forming an image by electrophotography includes a developing portion. The developing portion develops an electrostatic latent image formed on an image carrier such as a photosensitive drum. For example, the developing portion has a circulation-conveyance passage through which a developer is conveyed so as to be circulated, a conveying member that conveys the developer in the circulation-conveyance passage, and an opening portion that is provided in a wall surface at the upper side of the circulation-conveyance passage. A developer supply portion that supplies the developer to the interior of the developing portion is connected to the opening portion of the developing portion.

Here, an image forming apparatus is known in which an accumulation portion for the developer is formed in the circulation-conveyance passage and below the opening portion, so that the amount of the developer supplied from the developer supply portion can be caused to follow the amount of the developer consumed at the developing portion. In this image forming apparatus, when printing with a high coverage rate is consecutively executed, the amount of the developer supplied from the developer supply portion may not follow the amount of the developer consumed in the developing portion, so that the amount of the developer held in the developing portion may decrease. In this case, the amount of the developer supplied to the image carrier may become insufficient, so that a defect called void may occur in an image formed by the image forming apparatus. On the other hand, an image forming apparatus is known which is capable of executing a developer supply mode in which, when printing with a high coverage rate is consecutively executed, the developer within the circulation-conveyance passage is circulated by using the conveying member to continue supply of the developer from the developer supply portion to the developing portion, while execution of a printing process is suspended.

SUMMARY

An image forming apparatus according to one aspect of the present disclosure includes an image carrier, a developing portion, a developer supply portion, a first rotation control portion, and a second rotation control portion. The developing portion has a circulation-conveyance passage through which a developer is conveyed so as to be circulated, a conveying member configured to convey the developer within the circulation-conveyance passage in a predetermined direction, an opening portion formed at an upper side of the circulation-conveyance passage and configured to guide the developer supplied from outside, to the circulation-conveyance passage, and a reducing portion provided in the conveying member and configured to reduce an ability to convey the developer. The developing portion is configured to develop an electrostatic latent image formed on the image carrier, by using the developer conveyed in the circulation-conveyance passage. The developer supply portion is connected to the opening portion and configured to supply the developer to the developing portion. The first rotation control portion is configured to rotate the conveying member at a predetermined first speed when a printing process of forming an image on the basis of image data is executed. The second rotation control portion is configured to suspend execution of the printing process and rotate the conveying member at a predetermined second speed that is lower than the first speed, when an average coverage rate per page of a printed matter having a predetermined reference number of pages that are consecutively printed by the printing process exceeds a predetermined threshold.

An image forming method according to another aspect of the present disclosure is executed by an image forming apparatus including: an image carrier; a developing portion having a circulation-conveyance passage through which a developer is conveyed so as to be circulated, a conveying member configured to convey the developer within the circulation-conveyance passage in a predetermined direction, an opening portion formed at an upper side of the circulation-conveyance passage and configured to guide the developer supplied from outside, to the circulation-conveyance passage, and a reducing portion provided in the conveying member and configured to reduce an ability to convey the developer, the developing portion being configured to develop an electrostatic latent image formed on the image carrier, by using the developer conveyed in the circulation-conveyance passage; and a developer supply portion connected to the opening portion and configured to supply the developer to the developing portion, and includes a first step and a second step. In the first step, when a printing process of forming an image on the basis of image data is executed, the conveying member is rotated at a predetermined first speed. In the second step, when an average coverage rate per page of a printed matter having a predetermined reference number of pages that are consecutively printed by the printing process exceeds a predetermined threshold, execution of the printing process is suspended and the conveying member is rotated at a predetermined second speed that is lower than the first speed.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment of the present disclosure will be described with reference to the accompanying drawings in order to allow understanding of the present disclosure. It should be noted that the following embodiment is an example embodying the present disclosure and does not limit the technical scope of the present disclosure.

[Schematic Configuration of Image Forming Apparatus 10]

First, a schematic configuration of an image forming apparatus 10 according to the embodiment of the present disclosure will be described with reference to FIGS. 1 and 2. Here, FIG. 1 is a cross-sectional schematic diagram showing the configuration of the image forming apparatus 10.

The image forming apparatus 10 is a multifunction peripheral having a plurality of functions such as a scanning function to read image data from a document and a printing function to form an image on the basis of image data, as well as a facsimile function, a copy function, etc. The present disclosure is applicable to image forming apparatuses such as a printer apparatus, a facsimile apparatus, and a copy machine.

Figure 1:
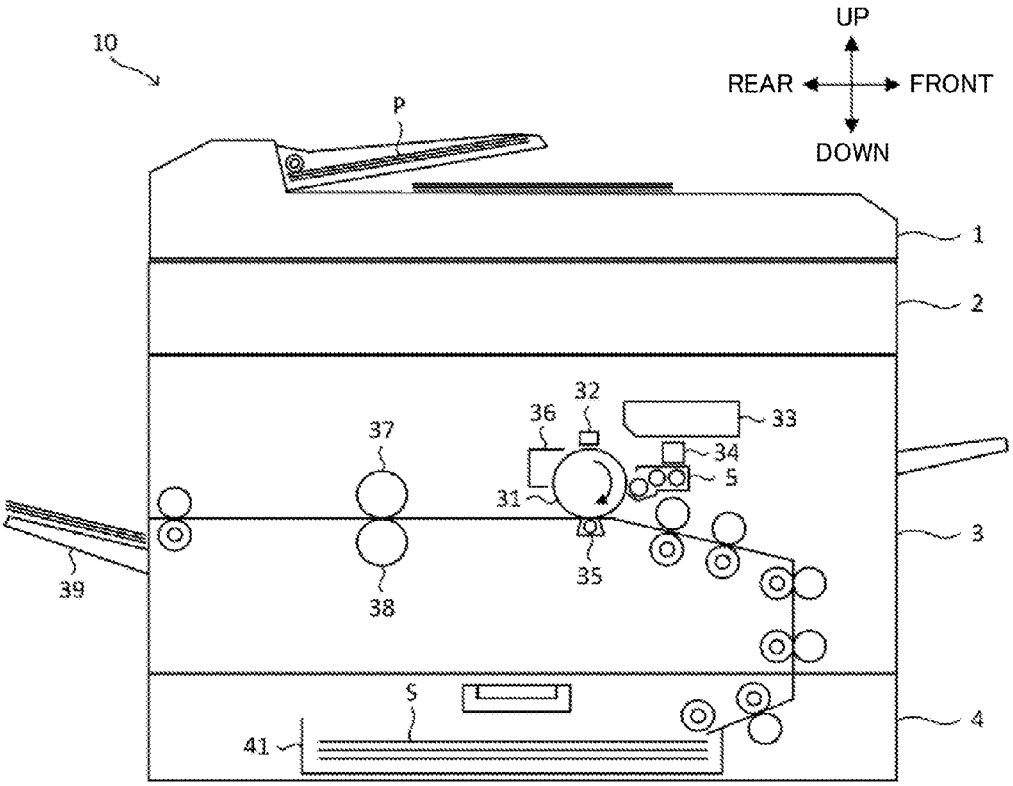
FIG. 1 is a diagram showing the configuration of an image forming apparatus according to an embodiment of the present disclosure.

As shown in FIG. 1, the image forming apparatus 10 includes an automatic document feeder (ADF) 1, an image reading portion 2, an image forming portion 3, a sheet feed portion 4, an operation display portion 6, and a control portion 7.

The ADF 1 includes a document set portion, a plurality of conveying rollers, a document holder, and a sheet discharge portion. At the ADF 1, a document P set on the document set portion is conveyed by the plurality of conveying rollers to the sheet discharge portion via an image reading position where an image is read by the image reading portion 2.

The image reading portion 2 includes a document table, a light source, a plurality of mirrors, an optical lens, and a CCD. At the image reading portion 2, image data is read from a document P placed on the document table or from a document P conveyed by the ADF 1. Specifically, in the image reading portion 2, light emitted from the light source to the document P and reflected by the document P is inputted via the plurality of mirrors and the optical lens into the CCD, whereby the image data on the document P is read.

The operation display portion 6 includes: a display portion, such as a liquid crystal display, which displays various kinds of information in accordance with control instructions from the control portion 7; and an operation portion, such as an operation key or a touch panel, which inputs various kinds of information to the control portion 7 in accordance with operations of a user.

The control portion 7 includes control devices such as a CPU, a ROM, a RAM, and an EEPROM that are not shown. The CPU is a processor that executes various calculation processes. The ROM is a non-volatile storage portion in which information such as a control program for causing the CPU to execute various processes is stored in advance. The RAM is a volatile storage portion, and the EEPROM is a non-volatile storage portion. The RAM and the EEPROM are used as temporary storage memories (working areas) for various processes executed by the CPU. At the control portion 7, various control programs stored in advance in the ROM are executed by the CPU. Accordingly, overall control of the image forming apparatus 10 is performed by the control portion 7. The control portion 7 may be composed of an electronic circuit such as an integrated circuit (ASIC) or may be a control portion provided independently of a main control portion that performs overall control of the image forming apparatus 10.

The image forming portion 3 is capable of executing a printing process of forming an image by electrophotography on the basis of image data read by the image reading portion 2. In addition, the image forming portion 3 is also capable of executing the printing process on the basis of image data inputted from an information processing apparatus such as an external personal computer. As shown in FIG. 1, the image forming portion 3 includes a photosensitive drum 31, a charging device 32, a laser scanning unit (LSU) 33, a developing portion 5, a developer supply portion 34, a transfer roller 35, a cleaning device 36, a fixing roller 37, a pressure roller 38, and a sheet discharge tray 39.

The sheet feed portion 4 feeds a sheet S on which an image is to be formed at the image forming portion 3. As shown in FIG. 1, the sheet feed portion 4 includes a sheet feed cassette 41 that contains sheets S. At the sheet feed portion 4, the sheets S contained in the sheet feed cassette 41 are taken out one by one, and are fed to an image forming position where an image is formed by the image forming portion 3.

At the image forming portion 3, an image is formed on the sheet S fed from the sheet feed portion 4, by the following procedure, and the sheet S having the image formed thereon is discharged to the sheet discharge tray 39. The sheets S are sheet materials such as paper, coated paper, postcards, envelopes, OHP sheets, or the like.

First, the surface of the photosensitive drum 31 is uniformly charged at a predetermined potential by the charging device 32. Next, light based on image data is applied by the laser scanning unit 33 to the surface of the photosensitive drum 31. Accordingly, an electrostatic latent image corresponding to the image data is formed on the surface of the photosensitive drum 31. Then, the electrostatic latent image on the photosensitive drum 31 is developed (visualized) as a toner image by the developing portion 5. A developer is supplied to the developing portion 5 from the developer supply portion 34 that is mountable to and detachable from the image forming portion 3. Here, the photosensitive drum 31 is an example of an image carrier in the present disclosure.

Subsequently, the toner image formed on the photosensitive drum 31 is transferred onto the sheet S by the transfer roller 35. Thereafter, the toner image transferred onto the sheet S is heated by the fixing roller 37 to be melted and fixed on the sheet S, when the sheet S passes through between the fixing roller 37 and the pressure roller 38. Toner remaining on the surface of the photosensitive drum 31 is removed by the cleaning device 36.

[Configurations of Developing Portion 5 and Developer Supply Portion 34]

Figure 3:
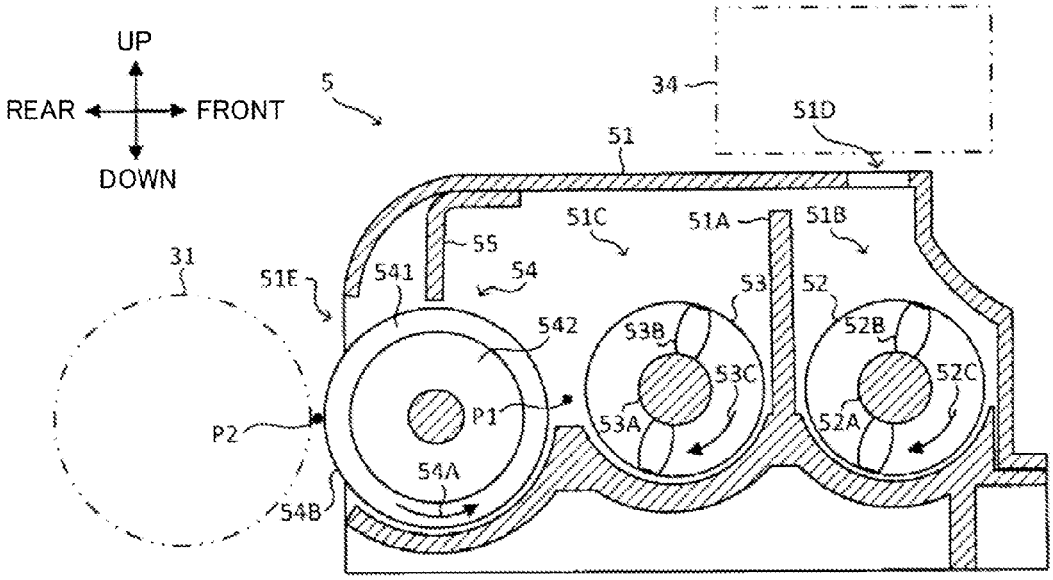
FIG. 3 is a diagram showing the configuration of a developing portion of the image forming apparatus according to the embodiment of the present disclosure.
Figure 4:
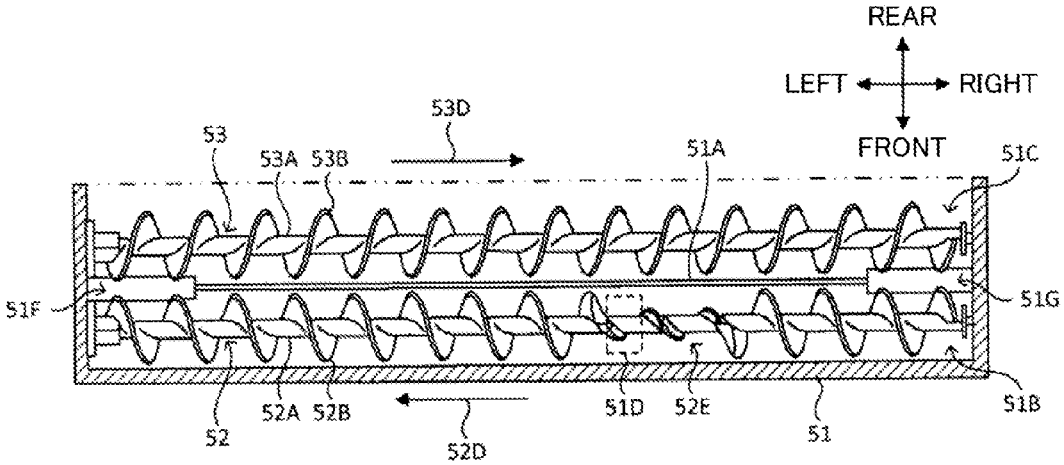
FIG. 4 is a diagram showing the configuration of a part of the developing portion of the image forming apparatus according to the embodiment of the present disclosure.
Figure 5:
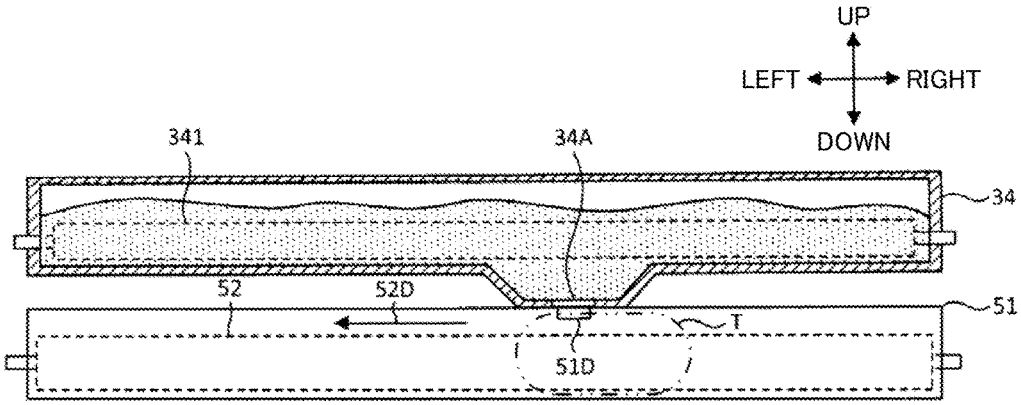
FIG. 5 is a diagram showing the configuration of a developer supply portion of the image forming apparatus according to the embodiment of the present disclosure.

Next, the developing portion 5 and the developer supply portion 34 will be described in detail with reference to FIGS. 3 to 5. Here, FIG. 3 is a cross-sectional schematic diagram showing the configuration of the developing portion 5. FIG. 4 is a plan schematic diagram showing a first conveying member 52 and a second conveying member 53 of the developing portion 5. FIG. 5 is a cross-sectional schematic diagram showing the configuration of the developer supply portion 34.

The developing portion 5 develops an electrostatic latent image on the photosensitive drum 31 by using toner contained in the developer. For example, the developer is a single-component developer that contains magnetic toner as a principal component. The developer may be a single-component developer that contains non-magnetic toner as a principal component.

As shown in FIGS. 3 and 4, the developing portion 5 includes a housing 51, the first conveying member 52, the second conveying member 53, a developing roller 54, and a restricting member 55.

The housing 51 contains each component of the developing portion 5 and also contains the developer. The housing 51 is long along the right-left direction of the image forming apparatus 10 (the depth direction of the sheet surface of FIG. 3). As shown in FIGS. 3 and 4, the interior of the housing 51 is divided into a first conveyance passage 51B and a second conveyance passage 51C by a partition wall 51A. The partition wall 51A is provided so as to be long along the longitudinal direction of the housing 51. Communication passages 51F and 51G are provided in both end portions, in the longitudinal direction, of the partition wall 51A so as to provide communication between the first conveyance passage 51B and the second conveyance passage 51C.

As shown in FIG. 3, an opening portion 51D is provided in an upper wall surface of the housing 51 and at the first conveyance passage 51B. The opening portion 51D is a through hole that guides the developer supplied from the developer supply portion 34, to the first conveyance passage 51B. An opening portion 51E is provided in a rear end portion of the housing 51 and at the second conveyance passage 51C. In the image forming apparatus 10, the developing portion 5 is disposed at such a position that the opening portion 51E is opposed to the photosensitive drum 31.

As shown in FIG. 5, the developer supply portion 34 is connected to the opening portion 51D of the developing portion 5. The developer supply portion 34 contains the developer to be supplied to the developing portion 5. The developer supply portion 34 is long along the right-left direction of the image forming apparatus 10, and is configured to be mountable to and detachable from the image forming portion 3. In a state where the developer supply portion 34 is mounted on the image forming portion 3, it is made possible to supply the developer from the developer supply portion 34 to the opening portion 51D.

A conveying member 341 is provided within the developer supply portion 34. The conveying member 341 continuously supplies the developer contained in the developer supply portion 34, from the developer supply portion 34 to the opening portion 51D. The conveying member 341 is rotatably supported at wall surfaces of both ends, in the longitudinal direction, of the developer supply portion 34. For example, the conveying member 341 is a conveyance screw having a helical blade formed along a rotation shaft thereof. In FIG. 5, the conveying member 341 is shown by a dotted line, since the conveying member 341 is located within the developer contained in the developer supply portion 34. A driving force is supplied from a driving portion 3A (see FIG. 2) such as a motor to the conveying member 341. Accordingly, the conveying member 341 is rotated, so that the developer contained in the developer supply portion 34 is conveyed in the axial direction of the rotation shaft of the conveying member 341 by the helical blade.

In the developer supply portion 34, an exhaust port 34A is formed below the rotation shaft of the conveying member 341 so as to lead to the opening portion 51D. When the conveying member 341 is rotationally driven, the developer within the developer supply portion 34 is supplied through the exhaust port 34A to the opening portion 51D. Accordingly, the developer within the developer supply portion 34 moves to the opening portion 51D and is supplied from the opening portion 51D to the first conveyance passage 51B of the housing 51.

The first conveying member 52 is rotatably provided in the first conveyance passage 51B of the housing 51. For example, as shown in FIGS. 3 and 4, the first conveying member 52 is a conveyance screw having a helical blade 52B formed along a rotation shaft 52A thereof. A driving force is supplied from the driving portion 3A to the first conveying member 52. Accordingly, the first conveying member 52 is rotated in a rotation direction 52C, so that the developer contained in the first conveyance passage 51B is conveyed along a conveyance direction 52D, while being agitated, by the helical blade 52B. In addition, the developer becomes triboelectrically charged due to the agitation by the helical blade 52B. Here, the first conveying member 52 is an example of a conveying member in the present disclosure. In addition, the conveyance direction 52D is an example of a predetermined direction in the present disclosure.

The developer conveyed by the first conveying member 52 flows through the communication passage 51F provided at the downstream side, in the conveyance direction 52D, of the first conveyance passage 51B and is contained in the second conveyance passage 51C.

The second conveying member 53 is rotatably provided in the second conveyance passage 51C of the housing 51. For example, as shown in FIGS. 3 and 4, the second conveying member 53 is a conveyance screw having a helical blade 53B formed along a rotation shaft 53A thereof. A driving force is supplied from the driving portion 3A to the second conveying member 53. Accordingly, the second conveying member 53 is rotated in a rotation direction 53C, so that the developer contained in the second conveyance passage 51C is conveyed along a conveyance direction 53D, while being agitated, by the helical blade 53B. In addition, the developer becomes triboelectrically charged due to the agitation by the helical blade 53B.

A part of the developer conveyed by the second conveying member 53 is supplied to the developing roller 54. The developing portion 5 develops an electrostatic latent image formed on the photosensitive drum 31, by using the developer supplied from the second conveying member 53 to the developing roller 54.

In addition, the remaining part of the developer conveyed by the second conveying member 53 flows through the communication passage 51G provided at the downstream side, in the conveyance direction 53D, of the second conveyance passage 51C and is contained in the first conveyance passage 51B. That is, at the developing portion 5, the first conveyance passage 51B, the communication passage 51F, the second conveyance passage 51C, and the communication passage 51G form a circulation-conveyance passage through which the developer is conveyed so as to be circulated. In the developing portion 5, the developer contained in the housing 51 is conveyed so as to be circulated through the circulation-conveyance passage by the first conveying member 52 and the second conveying member 53.

Here, in the image forming apparatus 10, as shown in FIG. 4, a reducing portion 52E is provided in the first conveying member 52. The reducing portion 52E reduces the ability to convey the developer by the first conveying member 52. For example, at the reducing portion 52E, the helical blade 52B is cut such that the outer diameter thereof is smaller than that at the other portion. Accordingly, in a region of the first conveyance passage 51B where the reducing portion 52E is provided, the amount of the conveyed developer is reduced, and an accumulation portion T (see FIG. 5) for the developer is formed. At the reducing portion 52E, the pitch of the helical blade 52B in the axial direction of the rotation shaft 52A may be set so as to be shorter than that at the other portion. In addition, at the reducing portion 52E, a cutout may be provided in the helical blade 52B. Furthermore, at the reducing portion 52E, rib members may be disposed on the peripheral edge portion of the helical blade 52B at equal intervals so as to be parallel to the rotation shaft 52A.

In the image forming apparatus 10, as shown in FIG. 4, the opening portion 51D is formed at the upper side of the reducing portion 52E. For example, the opening portion 51D is formed at the upper side of the downstream side, in the conveyance direction 52D, of the reducing portion 52E. Thus, supply of the developer from the developer supply portion 34 is restricted by the accumulation portion T, for the developer, which is formed below the opening portion 51D by the reducing portion 52E. Specifically, in the image forming apparatus 10, when the printing process is executed so that the amount of the developer held in the circulation-conveyance passage decreases, a force, by the accumulation portion T, pushing the developer brought in from the opening portion 51D, back to the developer supply portion 34 decreases, so that the developer is supplied from the developer supply portion 34. On the other hand, in the image forming apparatus 10, when the amount of the developer held in the circulation-conveyance passage increases due to the supply of the developer from the developer supply portion 34, the force of pushing the developer brought in from the opening portion 51D, back to the developer supply portion 34 by the accumulation portion T increases, so that the supply of the developer from the developer supply portion 34 is stopped. That is, in the image forming apparatus 10, the amount of the developer supplied from the developer supply portion 34 follows the amount of the developer consumed at the developing portion 5.

The developing roller 54 is rotatably provided in the housing 51. As shown in FIG. 3, the developing roller 54 is provided at a position, in the second conveyance passage 51C, rearward of the second conveying member 53 in the image forming apparatus 10 so as to be opposed to the second conveying member 53. A part of a circumferential surface 54B of the developing roller 54 is exposed from the opening portion 51E to the outside of the housing 51. The part of the circumferential surface 54B exposed to the outside of the housing 51 is opposed to the photosensitive drum 31. The developing roller 54 holds the developer contained in the housing 51, on the circumferential surface 54B.

As shown in FIG. 3, the developing roller 54 includes a developing sleeve 541 and a magnet 542. The developing sleeve 541 has a cylindrical shape and is rotatably provided in the housing 51. For example, the developing sleeve 541 is formed from a non-magnetic material such as aluminum. For example, the circumferential surface (circumferential surface 54B) of the developing sleeve 541 is subjected to a roughening treatment for adjusting the amount of the developer held thereon and the amount of friction thereof.

The magnet 542 is fixedly provided within the developing sleeve 541. The magnet 542 has a plurality of magnetic poles. For example, the magnet 542 has a restricting pole that generates a peak magnetic force at a position opposing the restricting member 55, and a developing pole that generates a peak magnetic force at a position opposing the photosensitive drum 31, etc.

At the developing roller 54, the developer having magnetism is attracted to the circumferential surface 54B by the magnetic pole of the magnet 542. Meanwhile, the developer is triboelectrically charged due to the agitation by the first conveying member 52 and the second conveying member 53, and thus adheres to the circumferential surface 54B due to electrostatic force. Therefore, a part of the developer conveyed by the second conveying member 53 adheres to the circumferential surface 54B at a supply position P1 (see FIG. 3) at which the second conveying member 53 and the developing roller 54 are opposed to each other. Accordingly, the developer is held on the circumferential surface 54B.

A driving force is supplied from the driving portion 3A to the developing roller 54. Accordingly, the developing roller 54 is rotated in a rotation direction 54A, so that the developer held on the circumferential surface 54B is conveyed from the supply position P1 to a development position P2 (see FIG. 3) at which the developing roller 54 is opposed to the photosensitive drum 31. In the case where a single-component developer that is composed of non-magnetic toner not having magnetism instead of magnetic toner, it is not necessary to provide magnetic poles within the developing sleeve 541.

The restricting member 55 is provided with a gap relative to the circumferential surface 54B of the developing roller 54. As shown in FIG. 3, the restricting member 55 is provided at the downstream side, in the rotation direction 54A, of the supply position P1 and at the upstream side, in the rotation direction 54A, of the development position P2. The restricting member 55 is provided so as to be long along the longitudinal direction of the housing 51. For example, the restricting member 55 has a blade shape and is formed from a metal having magnetism, or the like. A layer thickness of the developer held on the circumferential surface 54B of the developing roller 54 is restricted by the restricting member 55. Accordingly, a thin layer of the developer having a uniform thickness is formed on the circumferential surface 54B of the developing roller 54. The gap between the restricting member 55 and the circumferential surface 54B of the developing roller 54 may be arbitrarily set in accordance with the layer thickness of the developer formed by the restricting member 55.

Meanwhile, in the image forming apparatus 10, when printing with a high coverage rate is consecutively executed, the amount of the developer supplied from the developer supply portion 34 may not follow the amount of the developer consumed at the developing portion 5, so that the amount of the developer held in the developing portion 5 may decrease. In this case, the amount of the developer supplied to the photosensitive drum 31 may become insufficient, so that a defect called void may occur in an image formed by the image forming apparatus 10. On the other hand, an image forming apparatus is known which is capable of executing a developer supply mode in which, when printing with a high coverage rate is consecutively executed, the developer within the circulation-conveyance passage is circulated by using the first conveying member 52 and the second conveying member 53 to continue supply of the developer from the developer supply portion 34 to the developing portion 5, while execution of the printing process is suspended.

Here, in the developer supply mode, the developer supplied from the developer supply portion 34 via the opening portion 51D circulates through the circulation-conveyance passage without being consumed. Thus, in the developer supply mode, a larger amount of the developer is brought in to the upstream side, in the conveyance direction 52D, of the accumulation portion T (see FIG. 5), than that during execution of the printing process. Accordingly, the pressure at the accumulation portion T increases, so that supply of the developer from the developer supply portion 34 is hindered. That is, in the developer supply mode, when a certain time elapses, the amount of the developer supplied from the developer supply portion 34 decreases. On the other hand, in the image forming apparatus 10 according to the embodiment of the present disclosure, as described later, it is possible to inhibit a decrease in the amount of the developer supplied from the developer supply portion 34 in the developer supply mode, to shorten a supply time of the developer in the developer supply mode.

Specifically, a rotation control program for causing the CPU of the control portion 7 to execute a later-described rotation control process (see a flowchart in FIG. 6) is stored in advance in the ROM of the control portion 7. The rotation control program may be stored in a computer-readable storage medium such as a flash memory, read from the recording medium, and installed into the EEPROM or the like.

Figure 2:
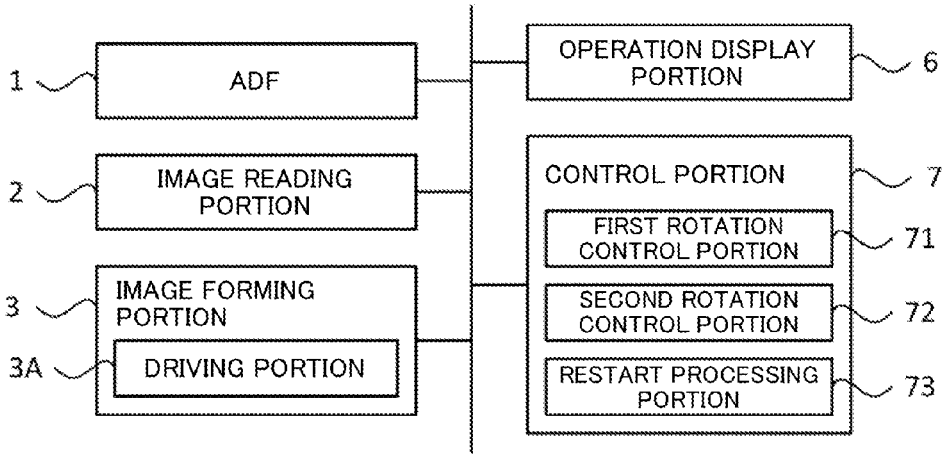
FIG. 2 is a block diagram showing the system configuration of the image forming apparatus according to the embodiment of the present disclosure.

As shown in FIG. 2, the control portion 7 includes a first rotation control portion 71, a second rotation control portion 72, and a restart processing portion 73. Specifically, the control portion 7 executes the rotation control program stored in the ROM, by using the CPU. Accordingly, the control portion 7 functions as the first rotation control portion 71, the second rotation control portion 72, and the restart processing portion 73.

When the printing process is executed by the image forming portion 3, the first rotation control portion 71 rotates the first conveying member 52 and the second conveying member 53 at a predetermined first speed. For example, the first rotation control portion 71 transmits a control signal to the driving portion 3A to cause the driving portion 3A to rotate the first conveying member 52 and the second conveying member 53 at the first speed. The first speed is set to an appropriate value in accordance with a printing speed of the image forming apparatus 10.

When a predetermined mode shift condition is satisfied, the second rotation control portion 72 suspends execution of the printing process and rotates the first conveying member 52 and the second conveying member 53 at a predetermined second speed that is lower than the first speed. That is, in the image forming apparatus 10, a state where the first conveying member 52 and the second conveying member 53 are rotated at the second speed by the second rotation control portion 72 is the developer supply mode.

Specifically, the mode shift condition is that an average coverage rate per page of a printed matter having a predetermined reference number of pages that are consecutively printed by the printing process exceeds a predetermined threshold. For example, in the image forming apparatus 10, the reference number of pages is set to 250 pages, and the threshold is set to 50%. The reference number of pages and the threshold may be arbitrarily set by an operation of the user on the operation display portion 6.

For example, each time a printed matter of one page is outputted by the printing process, the second rotation control portion 72 obtains the coverage rate of the printed matter of one page on the basis of image data. Then, when the cumulative total number of pages of a printed matter printed by the printing process reaches the reference number of pages, the second rotation control portion 72 calculates the average coverage rate per page of the printed matter having the reference number of pages. In addition, after the cumulative total number of pages exceeds the reference number of pages, each time a printed matter of one page is outputted, the second rotation control portion 72 calculates the average coverage rate per page of a printed matter having the reference number of pages traced back from this outputted printed matter.

When the sum of the cumulative total number of pages in the printing process executed previously and the cumulative total number of pages in the printing process executed next reaches the reference number of pages, the second rotation control portion 72 may calculate the average coverage rate per page of the printed matter having the reference number of pages.

For example, when the mode shift condition is satisfied, the second rotation control portion 72 stops input of image data from the control portion 7 to the laser scanning unit 33 and also stops application of a voltage to the charging device 32 and the transfer roller 35 by a power supply, which is not shown, to suspend execution of the printing process.

Then, the second rotation control portion 72 transmits a control signal to the driving portion 3A to cause the driving portion 3A to rotate the first conveying member 52 and the second conveying member 53 at the second speed. For example, the second speed is half the first speed. The second rotation control portion 72 may not decrease the rotation speed of the second conveying member 53 and may rotate only the first conveying member 52 at the second speed.

After a predetermined supply time elapses, the restart processing portion 73 restarts execution of the printing process. For example, in the image forming apparatus 10, the supply time is set to three minutes. The supply time may be arbitrarily set by an operation of the user on the operation display portion 6.

For example, after the supply time elapses, the restart processing portion 73 restarts input of image data from the control portion 7 to the laser scanning unit 33 and also restarts application of a voltage to the charging device 32 and the transfer roller 35 by the power supply, which is not shown, to restart execution of the printing process.

When the number of remaining pages to be printed at the time of suspension of the printing process is less than a predetermined specific number of pages, the restart processing portion 73 shortens the supply time. For example, in the image forming apparatus 10, the specific number of pages is set to 10 pages. The specific number of pages may be arbitrarily set by an operation of the user on the operation display portion 6.

For example, when the number of remaining pages to be printed at the time of suspension of the printing process is less than the specific number of pages, the restart processing portion 73 shortens the supply time to a time that is half the supply time.

When the supply time is shortened by the restart processing portion 73, the second rotation control portion 72 may rotate the first conveying member 52 and the second conveying member 53 at the second speed for the shortened time after end of the printing process.

[Rotation Control Process]

Figure 6:
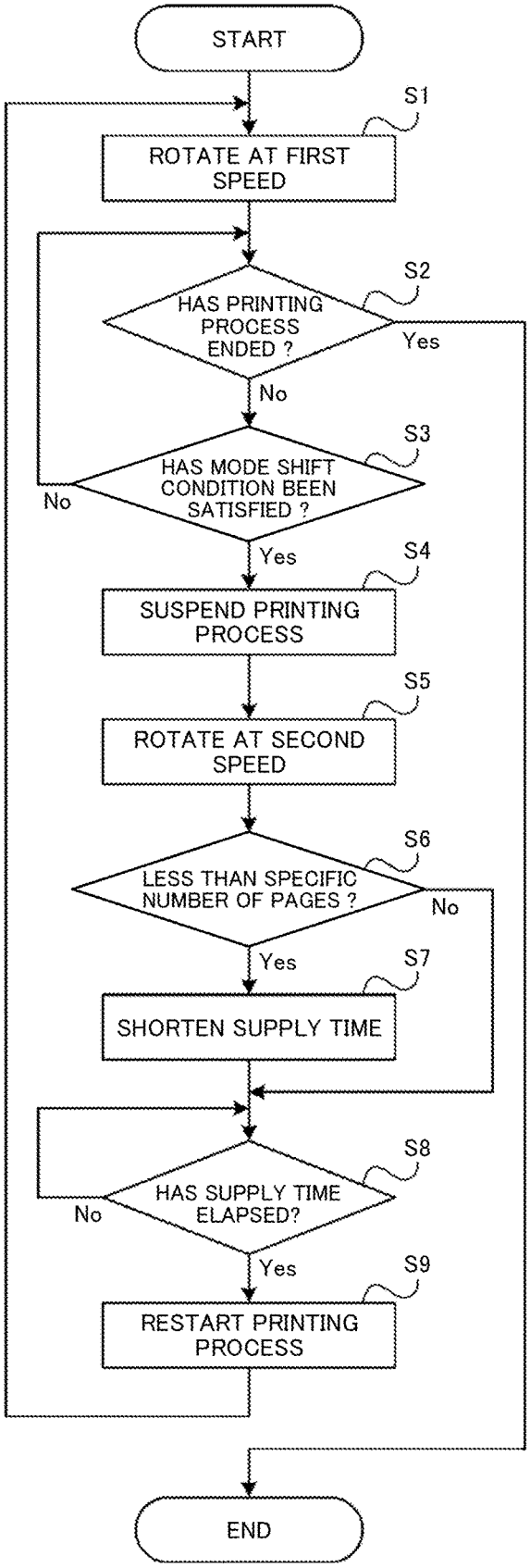
FIG. 6 is a flowchart showing an example of a rotation control process executed by the image forming apparatus according to the embodiment of the present disclosure.

Hereinafter, together with an example of the procedure of the rotation control process executed by the control portion 7 in the image forming apparatus 10, an image forming method of the present disclosure will be described with reference to FIG. 6. Here, S1, S2 . . . represent numbers of process procedures (steps) executed by the control portion 7. When the printing process is executed in the image forming apparatus 10, the rotation control process is executed together with the printing process.

<Step S1>

First, in step S1, the control portion 7 rotates the first conveying member 52 and the second conveying member 53 at the first speed. For example, the control portion 7 transmits a control signal to the driving portion 3A to cause the driving portion 3A to rotate the first conveying member 52 and the second conveying member 53 at the first speed. Here, the process in step S1 is an example of a first step in the present disclosure, and is executed by the first rotation control portion 71 of the control portion 7.

<Step S2>

In step S2, the control portion 7 determines whether the printing process has ended.

Here, when the control portion 7 determines that the printing process has ended (Yes in S2), the control portion 7 ends the rotation control process. When the printing process has not ended (No in S2), the control portion 7 shifts the process to step S3.

<Step S3>

In step S3, the control portion 7 determines whether the mode shift condition has been satisfied.

For example, each time a printed matter of one page is outputted by the printing process, the control portion 7 obtains the coverage rate of the printed matter of one page on the basis of image data. Subsequently, when the cumulative total number of pages of a printed matter printed by the printing process reaches the reference number of pages, the control portion 7 calculates the average coverage rate per page of the printed matter having the reference number of pages. In addition, after the cumulative total number of pages exceeds the reference number of pages, each time a printed matter of one page is outputted, the control portion 7 calculates the average coverage rate per page of a printed matter having the reference number of pages traced back from this outputted printed matter. Then, when the calculated average coverage rate exceeds the threshold, the control portion 7 determines that the mode shift condition has been satisfied.

Here, when the control portion 7 determines that the mode shift condition has been satisfied (Yes in S3), the control portion 7 shifts the process to step S4. When the mode shift condition has not been satisfied (No in S3), the control portion 7 shifts the process to step S2 and waits for end of the printing process or satisfaction of the mode shift condition.

<Step S4>

In step S4, the control portion 7 suspends execution of the printing process. For example, the control portion 7 stops input of image data to the laser scanning unit 33 and also stops application of a voltage to the charging device 32 and the transfer roller 35 by the power supply, which is not shown, to suspend execution of the printing process.

<Step S5>

In step S5, the control portion 7 rotates the first conveying member 52 and the second conveying member 53 at the second speed. For example, the control portion 7 transmits a control signal to the driving portion 3A to cause the driving portion 3A to rotate the first conveying member 52 and the second conveying member 53 at the second speed. Here, the processes in steps S3 to S5 are an example of a second step in the present disclosure, and are executed by the second rotation control portion 72 of the control portion 7.

When the rotation speed of each of the first conveying member 52 and the second conveying member 53 is decreased to the second speed, the time taken until the developer supplied from the opening portion 51D during execution of the developer supply mode reaches the upstream side, in the conveyance direction 52D, of the accumulation portion T (see FIG. 5), becomes long. Accordingly, timing at which supply of the developer from the developer supply portion 34 is restricted by the accumulation portion T in the developer supply mode is delayed. Therefore, a decrease in the amount of the developer supplied from the developer supply portion 34 in the developer supply mode is inhibited.

At the downstream end, in the conveyance direction 52D, of the accumulation portion T, accumulation of the developer is collapsed by the pressure of the developer conveyed by the reducing portion 52E of the first conveying member 52 and the pressure of the developer supplied from the opening portion 51D, and the developer collapsed from the accumulation of the developer is conveyed by the first conveying member 52. Here, when the rotation speed of the first conveying member 52 is decreased from the first speed to the second speed, the conveyance speed at the reducing portion 52E of the first conveying member 52 decreases. However, the amount of the developer conveyed at the reducing portion 52E is smaller than that at the other portion. Thus, even when the rotation speed of the first conveying member 52 is decreased, the ability to convey the developer at the reducing portion 52E almost does not decrease. Therefore, even when the rotation speed of the first conveying member 52 is decreased, influence on the amount of the accumulation of the developer collapsed at the downstream end, in the conveyance direction 52D, of the accumulation portion T (the amount of the developer conveyed from the accumulation portion T) is small, so that the amount of the developer supplied from the developer supply portion 34 almost does not decrease.

<Step S6>

In step S6, the control portion 7 determines whether the number of remaining pages to be printed at the time of suspension of the printing process is less than the specific number of pages.

Here, when the control portion 7 determines that the number of remaining pages to be printed at the time of suspension of the printing process is less than the specific number of pages (Yes in S6), the control portion 7 shifts the process to the step S7. When the number of remaining pages to be printed at the time of suspension of the printing process is not less than the specific number of pages (No in S6), the control portion 7 shifts the process to step S8.

<Step S7>

In step S7, the control portion 7 shortens the supply time. For example, the control portion 7 shortens the supply time to a time that is half the supply time.

<Step S8>

In step S8, the control portion 7 determines whether the supply time has elapsed from the time of suspension of the printing process in step S4. When the supply time is shortened in step S7, the control portion 7 determines whether the supply time shortened in step S7 has elapsed from the time of suspension of the printing process in step S4.

Here, when the control portion 7 determines that the supply time has elapsed (Yes in S8), the control portion 7 shifts the process to step S9. When the supply time has not elapsed (No in S8), the control portion 7 waits for elapse of the supply time in step S8.

<Step S9>

In step S9, the control portion 7 restarts execution of the printing process suspended in step S4. For example, the control portion 7 restarts input of image data to the laser scanning unit 33 and also restarts application of a voltage to the charging device 32 and the transfer roller 35 by the power supply, which is not shown, to restart execution of the printing process. Here, the processes in steps S6 to S9 are executed by the restart processing portion 73 of the control portion 7.

When it is determined in step S2 that the printing process has ended after the supply time is shortened in step S7, the control portion 7 may rotate the first conveying member 52 and the second conveying member 53 at the second speed for a time by which the supply time is shortened.

EXAMPLE

Figure 7:
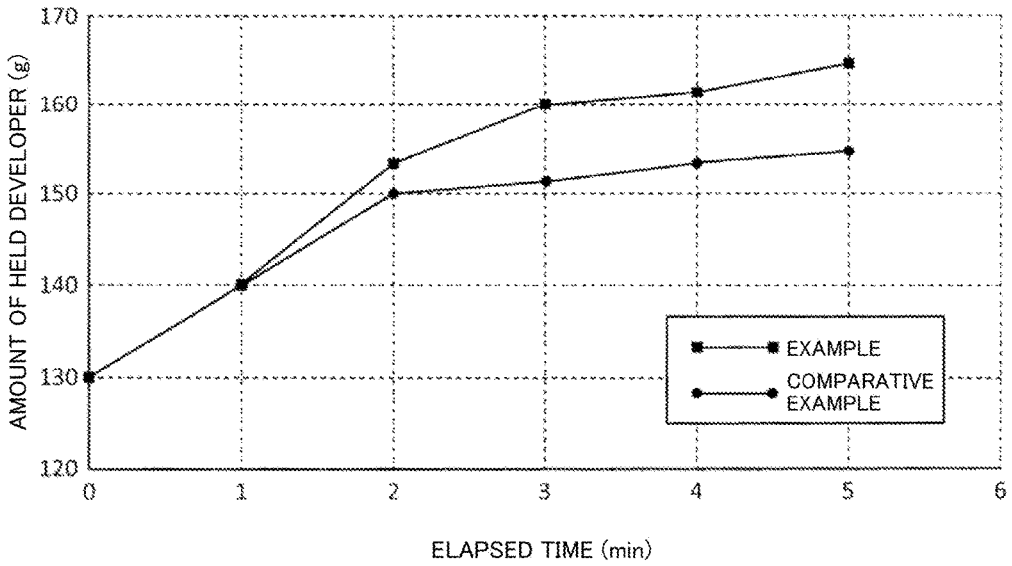
FIG. 7 is a diagram showing results of experiments using the image forming apparatus according to the embodiment of the present disclosure.
Figure 8:
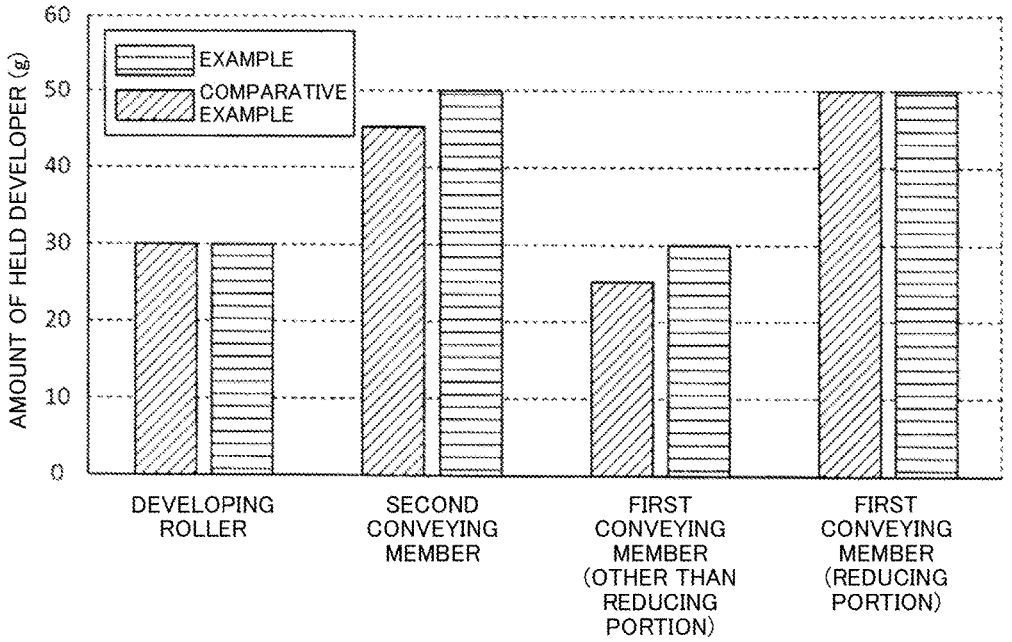
FIG. 8 is a diagram showing results of the experiments using the image forming apparatus according to the embodiment of the present disclosure.

An experiment was conducted for investigating transition of the amount of the developer held in the developing portion 5 in the developer supply mode in the image forming apparatus 10 according to the aforementioned embodiment. FIG. 7 shows results of the experiment. In addition, FIG. 8 shows a distribution of the developer at each portion of the developing portion 5 at a time point when three minutes elapsed from start of the developer supply mode in the experiment.

The experiment was conducted by a method in which, after the image forming apparatus 10 is caused to consecutively perform printing with a coverage rate of 50% on 250 sheets, the image forming apparatus 10 is caused to shift to the developer supply mode, and the amount of the developer held in the developing portion 5 during the developer supply mode is measured. In addition, in the experiment, the first speed was set to 23.4 rpm, and the second speed was set to 11.7 rpm, which is half the first speed. Moreover, the specifications of the image forming apparatus 10 during the experiment are as follows.

Drum linear velocity: 183.53 mm/sec

Printing speed: 35 ppm (page/minute)

Diameter of rotation shaft 52A of first conveying member 52: 10.0 mm

Pitch of helical blade 52B of first conveying member 52: 20.0 mm

Diameter of helical blade 52B of first conveying member 52: 22.5 mm

Reducing portion 52E: formed by cutting a 2.5-turn portion of the helical blade 52B in the axial direction of the rotation shaft 52A Diameter of rotation shaft 53A of second conveying member 53: 10.0 mm Pitch of helical blade 53B of second conveying member 53: 20.0 mm Diameter of helical blade 53B of second conveying member 53: 22.5 mm Opening portion 51D: 21.0 mm×8.0 mm

Comparative Example

An experiment similar to that as described above was conducted in which the second speed was set to the same speed as the first speed in the image forming apparatus 10. FIG. 7 shows results of the experiment. In addition, FIG. 8 shows a distribution of the developer at each portion of the developing portion 5 at a time point when three minutes elapsed from start of the developer supply mode in the experiment. The method of the experiment is the same as in the example.

According to the experiment results shown in FIG. 7, in the image forming apparatus 10 in the comparative example, the amount of the developer supplied from the developer supply portion 34 decreased after two minutes elapsed from start of the developer supply mode. On the other hand, in the image forming apparatus 10 in the example, the amount of the developer supplied from the developer supply portion 34 did not decrease even after two minutes elapsed from start of the developer supply mode, and the amount of the developer supplied decreased after three minutes elapsed. This is guessed to be due to the rotation speeds of the first conveying member 52 and the second conveying member 53 being decreased, resulting in the timing at which supply of the developer from the developer supply portion 34 is restricted by the accumulation portion T being delayed so that a decrease in the amount of the developer supplied from the developer supply portion 34 is inhibited.

In addition, according to FIG. 8, at the second conveying member 53 and the portion of the first conveying member 52 other than the reducing portion 52E, the amount of the developer held is larger in the image forming apparatus 10 in the example than in the image forming apparatus 10 in the comparative example. This is also guessed to be due to the rotation speeds of the first conveying member 52 and the second conveying member 53 being decreased, resulting in the timing at which supply of the developer from the developer supply portion 34 is restricted by the accumulation portion T being delayed so that a decrease in the amount of the developer supplied from the developer supply portion 34 is inhibited.

As described above, in the image forming apparatus 10, when the mode shift condition is satisfied in the printing process, execution of the printing process is suspended, and the first conveying member 52 and the second conveying member 53 are rotated at the second speed, which is lower than the first speed during execution of the printing process. Accordingly, a decrease in the amount of the developer supplied from the developer supply portion 34 in the developer supply mode is inhibited, so that the supply time of the developer in the developer supply mode is shortened.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an image carrier;

a developing portion having a circulation-conveyance passage through which a developer is conveyed so as to be circulated, a conveying member configured to convey the developer within the circulation-conveyance passage in a predetermined direction, an opening portion formed at an upper side of the circulation-conveyance passage and configured to guide the developer supplied from outside, to the circulation-conveyance passage, and a reducing portion provided in the conveying member and configured to reduce an ability to convey the developer, the developing portion being configured to develop an electrostatic latent image formed on the image carrier, by using the developer conveyed in the circulation-conveyance passage;

a developer supply portion connected to the opening portion and configured to supply the developer to the developing portion;

a first rotation control portion configured to rotate the conveying member at a predetermined first speed when a printing process of forming an image on the basis of image data is executed;

a second rotation control portion configured to suspend execution of the printing process and rotate the conveying member at a predetermined second speed that is lower than the first speed, when an average coverage rate per page of a printed matter having a predetermined reference number of pages that are consecutively printed by the printing process exceeds a predetermined threshold; and a restart processing portion configured to restart execution of the printing process after a predetermined supply time elapses, wherein the restart processing portion shortens the supply time when a number of remaining pages to be printed at a time of suspension of the printing process is less than a predetermined specific number of pages.

2. The image forming apparatus according to claim 1, wherein the opening portion is formed at an upper side of the reducing portion.

3. The image forming apparatus according to claim 2, wherein the opening portion is formed at an upper side of a downstream side, in the direction, of the reducing portion.

4. The image forming apparatus according to claim 1, wherein the conveying member is a conveyance screw rotatably provided in the circulation-conveyance passage and having a helical blade formed along a rotation shaft thereof, and the helical blade has an outer diameter smaller at the reducing portion than at another portion.

5. The image forming apparatus according to claim 1, wherein the circulation-conveyance passage includes a first conveyance passage and a second conveyance passage, the conveying member conveys the developer in the first conveyance passage in the direction, the opening portion is formed at an upper side of the first conveyance passage, and the developing portion develops the electrostatic latent image formed on the image carrier, by using the developer conveyed in the second conveyance passage.

6. An image forming method executed by an image forming apparatus including: an image carrier; a developing portion having a circulation-conveyance passage through which a developer is conveyed so as to be circulated, a conveying member configured to convey the developer within the circulation-conveyance passage in a predetermined direction, an opening portion formed at an upper side of the circulation-conveyance passage and configured to guide the developer supplied from outside, to the circulation-conveyance passage, and a reducing portion provided in the conveying member and configured to reduce an ability to convey the developer, the developing portion being configured to develop an electrostatic latent image formed on the image carrier, by using the developer conveyed in the circulation-conveyance passage; and a developer supply portion connected to the opening portion and configured to supply the developer to the developing portion, the image forming method comprising:

a first step of rotating the conveying member at a predetermined first speed when a printing process of forming an image on the basis of image data is executed;

a second step of suspending execution of the printing process and rotating the conveying member at a predetermined second speed that is lower than the first speed, when an average coverage rate per page of a printed matter having a predetermined reference number of pages that are consecutively printed by the printing process exceeds a predetermined threshold; and a third step of restarting execution of the printing process after a predetermined supply time elapses, wherein in the third step, the supply time is shortened when a number of remaining pages to be printed at a time of suspension of the printing process is less than a predetermined specific number of pages.

* * * * *